US011749888B2

(12) United States Patent
Wang et al.

(10) Patent No.: US 11,749,888 B2
(45) Date of Patent: Sep. 5, 2023

(54) SWITCHABLE TRANSMISSION MECHANISM INCLUDING GEAR ASSEMBLIES AXIALLY ENGAGEABLE/DISENGAGEABLE WITH A RESPECTIVE TRANSMISSION ROD

(71) Applicant: CommScope Technologies LLC, Hickory, NC (US)

(72) Inventors: Qiang Wang, Suzhou (CN); Junfeng Yu, Suzhou (CN); Dongmin Wang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 224 days.

(21) Appl. No.: 17/326,716

(22) Filed: May 21, 2021

(65) Prior Publication Data

US 2021/0408679 A1 Dec. 30, 2021

(30) Foreign Application Priority Data

Jun. 24, 2020 (CN) ..... 202010587211.5

(51) Int. Cl.

| | |
|---|---|
| ***H01Q 3/32*** | (2006.01) |
| ***H01P 1/18*** | (2006.01) |
| ***H01Q 1/24*** | (2006.01) |

(52) U.S. Cl.

CPC ..... *H01Q 3/32* (2013.01); *H01P 1/18* (2013.01); *H01Q 1/246* (2013.01)

(58) Field of Classification Search

CPC ..... H01P 1/18; H01Q 3/32
USPC ..... 333/156, 139
See application file for complete search history.

(56) References Cited

U.S. PATENT DOCUMENTS

2017/0373379 A1* 12/2017 Schmutzler ..... F16M 11/048
2019/0027825 A1* 1/2019 Fang et al. ..... H01Q 1/1264

* cited by examiner

*Primary Examiner* — Benny T Lee
(74) *Attorney, Agent, or Firm* — Myers Bigel, P.A.

(57) ABSTRACT

The present disclosure relates to a switchable transmission mechanism for a base station antenna. The switchable transmission mechanism includes a plurality of axially drivable members, each of which is mounted on a corresponding one of a plurality of transmission rods arranged in parallel and is configured to be connected with a corresponding one of a plurality of phase shifters in the base station antenna; a transmission unit including a first gear assembly and a second gear assembly transmissibly connected to the first gear assembly, where the second gear assembly is engageable with or dis-engageable from any one of the transmission rods via a rod adapter that is movable between an engaged position and a disengaged position along an axial direction; and a switch unit configured to move the second gear assembly along a lateral direction perpendicular to the axial direction when the second gear assembly is disengaged from the transmission rod, so that the switchable transmission mechanism can selectively drive any one of the transmission rods.

27 Claims, 6 Drawing Sheets

SWITCHABLE TRANSMISSION MECHANISM INCLUDING GEAR ASSEMBLIES AXIALLY ENGAGEABLE/DISENGAGEABLE WITH A RESPECTIVE TRANSMISSION ROD

RELATED APPLICATION(S)

The present application claims priority from and the benefit of Chinese Patent Application No. 202010587211.5, filed Jun. 24, 2020, the disclosure of which is hereby incorporated herein in its entirety.

FIELD

The present disclosure relates generally to a communication system. More particularly, the present disclosure relates to a switchable transmission mechanism for a base station antenna.

BACKGROUND

Cellular communication systems are used to provide wireless communications to fixed and mobile subscribers. A cellular communication system may include a plurality of base stations, each of which provides a wireless cellular service for a specific coverage area that is typically referred to as a "cell". Each base station may include one or more base station antennas for transmitting radio frequency ("RF") signals to and receiving RF signals from the subscribers that are within the cell served by the base station. Base station antennas are directional devices that can concentrate the RF energy transmitted in or received from certain directions.

Modern base station antennas typically include two, three, or more linear (or planar) arrays of radiating elements, where each linear array has an electronically adjustable down tilt. The linear arrays usually include cross-polarized radiating elements, and a separate phase shifter is provided for electronically adjusting the down tilt of the antenna beam for each polarization, so that the antenna may include twice as many phase shifters as linear arrays. Remote electronic tilt ("RET") actuators and associated mechanical transmission mechanism may be provided in the antenna to adjust the phase shifters.

Conventionally, each phase shifter is equipped with a separate RET actuator, resulting in that the base station antenna including many RET actuators, and thereby significantly increasing the size, weight, and cost of the base station antenna. So-called "multi-RET actuators" are also known, which can selectively adjust one of multiple phase shifters via a switchable transmission mechanism. However, the switchable transmission mechanisms used in conventional "multi-RET actuators" usually contain a large number of components, which increases both the size and the complexity of the switchable transmission mechanism.

SUMMARY OF THE INVENTION

It is one object of the present disclosure to provide a switchable transmission mechanism for a base station antenna that is capable of overcoming at least one defect in the prior art.

According to one embodiment of the present disclosure, the switchable transmission mechanism for the base station antenna comprises: a plurality of axially drivable members, each member is mounted on a corresponding one of a plurality of transmission rods arranged in parallel and is configured to be connected with a corresponding one of a plurality of phase shifters in the base station antenna; a transmission unit including a first gear assembly and a second gear assembly transmissibly connected to the first gear assembly, wherein the second gear assembly is engageable with or dis-engageable from any one of the transmission rods via a rod adapter that is movable between an engaged position and a disengaged position along an axial direction; and a switch unit configured to move the second gear assembly along a lateral direction perpendicular to the axial direction when the second gear assembly is disengaged from the transmission rod, so that the switchable transmission mechanism can selectively drive any one of the transmission rods.

According to one embodiment of the present disclosure, the first gear assembly and the second gear assembly are arranged substantially at a same height.

According to one embodiment of the present disclosure, the first gear assembly comprises a first gear and a second gear that mesh with each other, the second gear assembly comprises a third gear and a fourth gear that mesh with each other, wherein the third gear is transmissibly connected to the second gear via a transmission shaft extending along the lateral direction, and the transmission shaft has a non-circular peripheral shape.

According to one embodiment of the present disclosure, a central axis of the first gear and a central axis of the second gear are perpendicular to each other.

According to one embodiment of the present disclosure, the first gear is a bevel gear, and the second gear comprises a bevel gear portion that meshes with the first gear.

According to one embodiment of the present disclosure, a center axis of the third gear and a center axis of the fourth gear are perpendicular to each other.

According to one embodiment of the present disclosure, both the third gear and the fourth gear are bevel gears.

According to one embodiment of the present disclosure, the third gear and the fourth gear are rotatably clamped in a gear holder so that the third gear and the fourth gear can move laterally in response to a lateral movement of the gear holder.

According to one embodiment of the present disclosure, the gear holder is made of plastic and comprises an upper half and a lower half.

According to one embodiment of the present disclosure, the switchable transmission mechanism comprises a guide rod for guiding lateral movement of the gear holder.

According to one embodiment of the present disclosure, the first gear is configured to be driven by a first motor.

According to one embodiment of the present disclosure, the fourth gear is configured to be engaged with or disengaged from any one of the transmission rods via the rod adapter.

According to one embodiment of the present disclosure, the rod adapter is rotatably clamped in a rod adapter holder so that the rod adapter can move axially between the engaged position and the disengaged position in response to an axial movement of the rod adapter holder and move laterally in response to a lateral movement of the rod adapter holder.

According to one embodiment of the present disclosure, the rod adapter holder is made of plastic and comprises an upper half and a lower half.

According to one embodiment of the present disclosure, the switchable transmission mechanism comprises a screw for driving the rod adapter holder to move the latter laterally.

According to one embodiment of the present disclosure, the switchable transmission mechanism further comprises a guide rod for guiding lateral movement of the rod adapter holder.

According to one embodiment of the present disclosure, the switch unit comprises an axial drive assembly and a lateral drive assembly, wherein the axial drive assembly is configured to move the rod adapter between the engaged position and the disengaged position along the axial direction, and the lateral drive assembly is configured to drive the second gear assembly along the lateral direction when the rod adapter is disengaged from the transmission rod.

According to one embodiment of the present disclosure, the lateral drive assembly comprises an axially movable sliding plate and a transmission shaft for axially moving the sliding plate, and the sliding plate is configured to move the rod adapter between the engaged position and the disengaged position along the axial direction when it moves axially.

According to one embodiment of the present disclosure, the transmission shaft is configured to be driven by a second motor.

According to one embodiment of the present disclosure, one end of the transmission shaft is screwed to an end surface of the sliding plate to axially move the sliding plate when the transmission shaft rotates, and the other end of the transmission shaft is provided with a spur gear that meshes with another spur gear installed at an end of a motor adapter to allow the second motor to drive the transmission shaft via the motor adapter.

According to one embodiment of the present disclosure, the lateral drive assembly comprises a third gear assembly configured to laterally move the rod adapter by rotating a screw.

According to one embodiment of the present disclosure, the third gear assembly is configured to transmissibly connected to the first gear assembly so that the third gear assembly and the first gear assembly are driven by a same driving device.

According to one embodiment of the present disclosure, the third gear assembly comprises a fifth gear and a sixth gear, wherein when the rod adapter is disengaged from the transmission rod, the fifth gear and the sixth gear mesh with each other, and when the rod adapter is engaged with the transmission rod, the fifth gear and the sixth gear are separated from each other.

According to one embodiment of the present disclosure, both the fifth gear and the sixth gear are spur gears.

According to one embodiment of the present disclosure, a size of a pitch of the screw can be selected to obtain a desired lateral movement speed of the rod adapter.

According to one embodiment of the present disclosure, the first gear, the second gear, the third gear, the fourth gear, and the transmission shaft are made of plastic.

According to one embodiment of the present disclosure, the fifth gear, the sixth gear, and the screw are made of plastic.

According to one embodiment of the present disclosure, the switchable transmission mechanism comprises a locking mechanism, wherein the locking mechanism is configured to prevent the transmission rod from rotating when the rod adapter is disengaged from the transmission rod, so as to avoid changing phase angle of the phase shifter.

According to one embodiment of the present disclosure, the locking mechanism comprises bushings installed at one end of each transmission rod, wherein each bushing comprises a flange, a side surface of which is provided with a plurality of keys distributed along a circumferential direction of the flange and extending along an axial direction of the bushing, the keys being configured to mate with key slots provided in a frame of the switchable transmission mechanism to achieve locking.

According to one embodiment of the present disclosure, the locking mechanism comprises elastic members, and when the rod adapter is disengaged from the transmission rod, the elastic members can automatically push the bushings along the axial direction to a position where the keys mate with the key slots.

It is to be noted that, various aspects of the present disclosure described with respect to one embodiment, although not specifically described with respect to other different embodiments, may be incorporated into the other different embodiments. In other words, all embodiments and/or features of any embodiment may be combined in any manner and/or combination, as long as they are not contradictory to one another.

BRIEF DESCRIPTION OF THE DRAWINGS

After reading the embodiments hereinafter in conjunction with the accompanying drawings, a plurality of aspects of the present disclosure will be better understood, wherein.

It should be understood that, in all the drawings, the same reference signs refer to the same elements throughout the detail description of the drawings. In the drawings, for the sake of clarity, sizes of certain features may be modified and may not be drawn to scale.

DETAILED DESCRIPTION OF THE INVENTION

Figure 1:
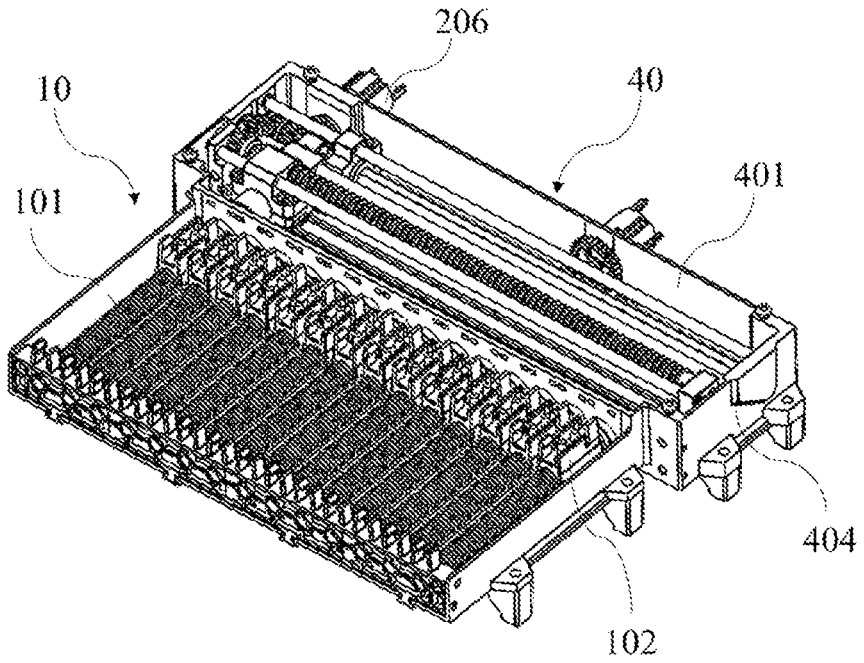
FIG. 1 shows a perspective view of a switchable transmission mechanism for a base station antenna according to an embodiment of the present disclosure.

The present disclosure will be described below with reference to the drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein may be combined in various ways to provide more additional embodiments.

It should be understood that, the wordings in the specification are only used for describing particular embodiments and are not intended to define the present disclosure. All the terms used in the specification (including the technical terms and scientific terms) have meanings as normally understood by a person skilled in the art, unless otherwise defined. For the sake of conciseness and/or clarity, the well-known functions or constructions may not be described in detail any longer.

The singular forms "a/an", "said" and "the" as used in the specification, unless clearly indicated, all contain the plural forms. The wordings "comprising", "containing" and "including" used in the specification indicate the presence of the claimed features, but do not expel the presence of one or more other features. The wording "and/or" as used in the specification includes any and all combinations of one or more of the relevant items listed.

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or there may be present with an intermediate element.

In the specification, the terms "first", "second", "third" and the like are used for convenient description only but not intended to be restrictive. Any technical features represented by "first", "second", "third" and the like are interchangeable.

In the specification, the spatial relation wordings such as "up", "down", "forth", "back", "top", "bottom" and the like may describe a relation of one feature with another feature in the drawings. It should be understood that, the spatial relation wordings also contain different orientations of the apparatus in use or operation, in addition to containing the orientations shown in the drawings. For example, when the apparatus in the drawings is turned over, the features previously described as "below" other features may be described to be "above" other features at this time. The apparatus may also be otherwise oriented (rotated 90 degrees or at other orientations). At this time, the relative spatial relations will be explained correspondingly.

Referring to FIG. 1, a switchable transmission mechanism 10 for a base station antenna (especially a multi-band base station antenna) according to an embodiment of the present disclosure is shown. The switchable transmission mechanism 10 is used to selectively adjust one of a plurality of phase shifters in the base station antenna in order to adjust the pointing angle (such as the elevation or "downtilt" angle) of an antenna beam generated by the base station antenna. As shown in FIG. 1, the switchable transmission mechanism 10 may comprise a plurality of transmission rods 101 arranged in parallel, and each transmission rod 101 is provided with a corresponding axially drivable member 102 that is configured to move along the axis of the associated transmission rod 101. Each axially drivable member 102 may be connected to a movable element of a corresponding phase shifter to adjust a setting of the phase shifter by the axial movement of the axially drivable member 102. In the embodiment shown in FIG. 1, the transmission rod 101 is shown as a screw, and the axially drivable member 102 is shown as a piston with a rod clip. One end of a corresponding mechanical link (not shown) may be connected to the piston via the rod clip, and the other end may be directly or indirectly connected to the movable element of the corresponding phase shifter. The presence of the mechanical link prevents the piston from rotating in response to the rotation of the screw. The piston may have internal threads to mate with external threads on the corresponding screw. Therefore, the piston can be configured to move back and forth along the screw in an axial direction when the screw rotates, thereby driving the movable element of the corresponding phase shifter to adjust the downtilt angle of the antenna beams formed by the RF signals that are transmitted through the phase shifter. In the embodiment shown in FIG. 1, the switchable transmission mechanism 10 comprises 14 transmission rods 101 arranged in parallel. However, the present disclosure is not limited to this. The number of transmission rods 101 can be increased or decreased as required.

Figure 2:
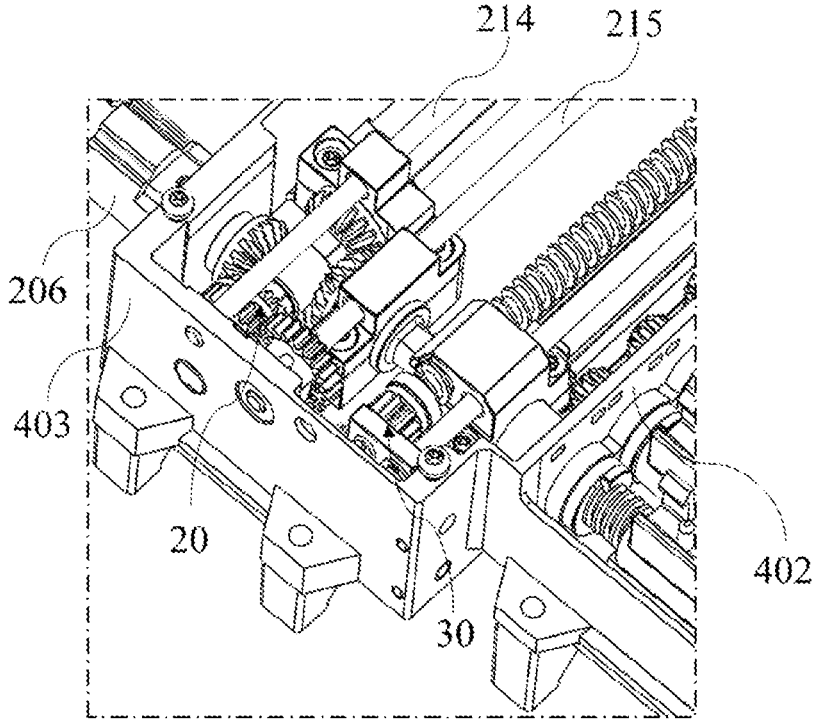
FIG. 2 shows a partial perspective view of the switchable transmission mechanism for a base station antenna according to an embodiment of the present disclosure.

As shown more clearly in FIG. 2, the switchable transmission mechanism 10 may comprise a transmission unit 20 and a switch unit 30. The transmission unit 20 is configured to transmissibly connect to one of the plurality of transmission rods 101 to drive the transmission rod to rotate. The switch unit 30 is configured to move at least a part of the transmission unit 20 so that the transmission unit 20 can be transmissibly connected with any one of the transmission rods 101. The transmission unit 20 and the switch unit 30 may be installed in a frame 40. As shown in FIG. 1, the frame 40 may comprise a bottom wall and a first side wall 401, a second side wall 402 (FIG. 2) opposite the first side wall, a first end wall 403 (FIG. 2), and a second end wall 404 opposite the first end wall that extend upward from the bottom wall. The transmission unit 20 and the switch unit 30 can be separated from the transmission rods 101 by the second side wall 402.

Figure 3:
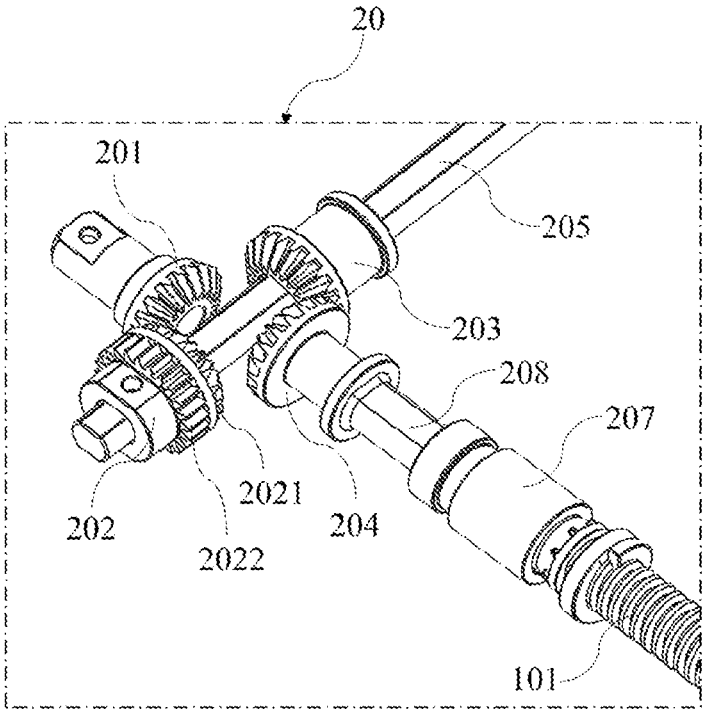
FIG. 3 and FIG. 4 show a specific structure of a transmission unit of the switchable transmission mechanism for a base station antenna according to an embodiment of the present disclosure.
Figure 4:
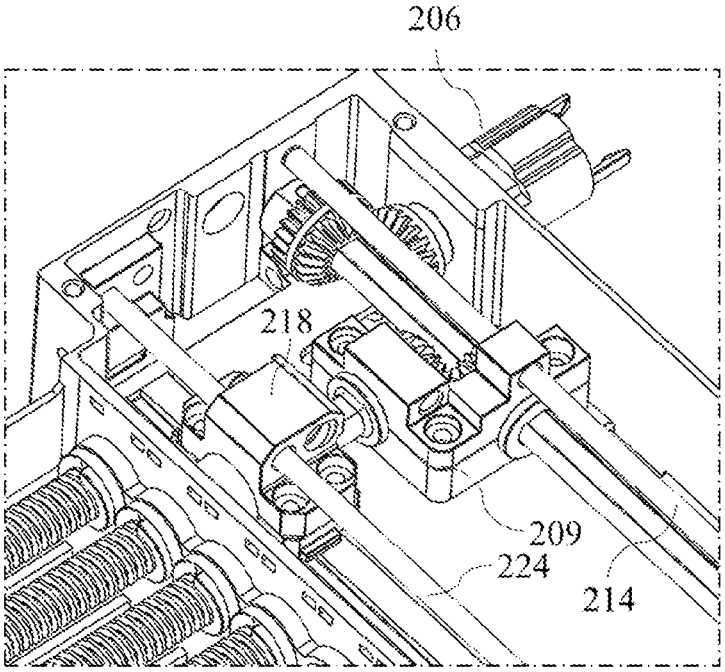

Referring to FIG. 3 and FIG. 4, a specific structure of the transmission unit 20 according to an embodiment of the present disclosure is shown. As shown in FIG. 3, the transmission unit 20 may comprise a first gear assembly composed of a first gear 201 and a second gear 202 that mesh with each other and a second gear assembly composed of a third gear 203 and a fourth gear 204 that mesh with each other. The first gear assembly may be fixed on corresponding walls of the frame 40, and the second gear assembly may be movable in a lateral direction perpendicular to the axial direction of the transmission rods 101 to transmissibly connect with any one of the transmission rods 101 in different positions (see also, e.g., FIG. 1). Such a configuration allows the transmission unit 20 of the present disclosure to be connectable with any one of the plurality of transmission rods 101 by means of the laterally movable second gear assembly only, thereby greatly reducing the component number and simplifying the structure of the transmission unit 20.

In embodiments according to the present disclosure, as shown in FIG. 2 and FIG. 3, the first gear 201 and the second gear 202 may be rotatably fixed to the first side wall 401 and the first end wall 403 that is perpendicular to the first side wall 401 of the frame 40 at a substantially same height or plane, so that a center axis of the first gear 201 is arranged substantially perpendicular to a center axis of the second gear 202. As shown in FIG. 3, the third gear 203 is transmissibly connected to the second gear 202 via a laterally extending transmission shaft 205. The transmission shaft 205 has a non-circular peripheral shape, so that the third gear 203 can translate laterally along the transmission shaft 205 but cannot rotate relative to the transmission shaft 205. The fourth gear 204 and the third gear 203 are arranged at a substantially same height or plane. A center axis of the fourth gear 204 is arranged substantially perpendicular to a center axis of the third gear 203, and the center axis of the fourth gear 204 is parallel to the axial direction of the transmission rod 101 to facilitate the transmissible connection between the fourth gear 204 and any one of the transmission rods 101. Such a configuration not only makes the first gear 201, the second gear 202, the third gear 203, and the fourth gear 204 at a substantially same height or plane, but also makes the first gear 201, the second gear 202, the third gear 203, and the fourth gear 204 more compact, so that the volume of space occupied by the transmission unit 20 can be significantly reduced. In embodiments according to the present disclosure, the first gear 201, the second gear 202, the third gear 203, and the fourth gear 204 are configured as bevel gears or comprise bevel gear portions.

As shown in FIG. 3, the first gear 201 may be transmissibly connected to a first motor (not shown) via a motor adapter 206. The fourth gear 204 can be transmissibly connected to any one of the transmission rods 101 via a rod adapter 207. The rod adapter 207 is configured to be movable along the axial direction of the transmission rod 101 between an engaged position where the rod adapter 207 is engaged with the transmission rod 101 and a disengaged position where the rod adapter 207 is disengaged from the transmission rod 101. Specifically, as shown in FIG. 3, one end of the fourth gear 204 is provided with a shaft 208 that mates with the rod adapter 207. The shaft 208 can be inserted into an axial cavity of the rod adapter 207. The shaft 208 of the fourth gear 204 and the axial cavity of the rod adapter 207 have non-circular shapes matching each other, so that the rod adapter 207 can translate along the shaft 208 between the engaged position and the disengaged position but cannot rotate relative to the shaft 208.

When the rod adapter 207 is engaged with any one of the transmission rods 101, the operation of adjusting the phase shifter can be performed. During the operation of driving the phase shifter, the first motor drives the first gear 201 via the motor adapter 206, the first gear 201 drives the second gear 202 meshed therewith, the second gear 202 drives the third gear 203 via the transmission shaft 205, the third gear 203 drives the fourth gear 204 meshed therewith, and the fourth gear 204 in turn drives any one of the transmission rods 101 connected thereto via the rod adapter 207.

Figure 5:
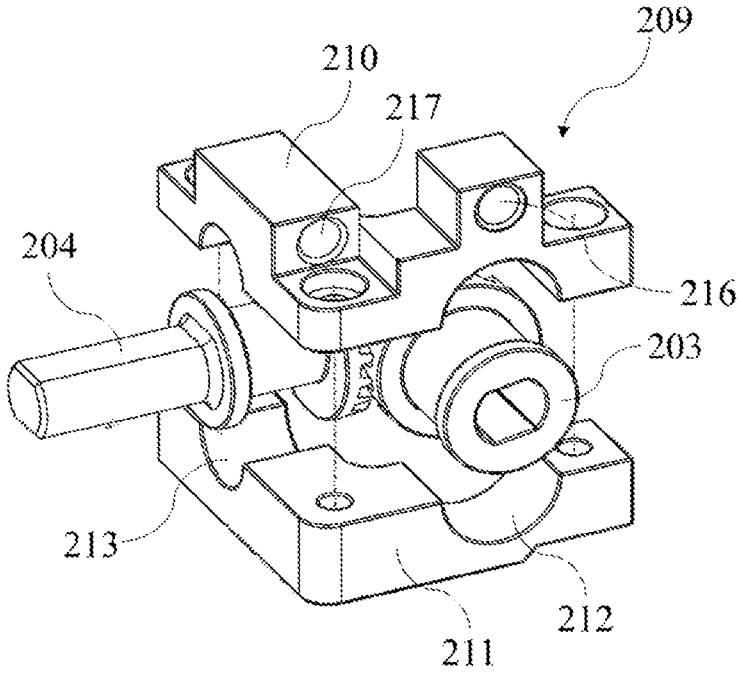
FIG. 5 shows a perspective view of a gear holder according to an embodiment of the present disclosure.

When the rod adapter 207 is disengaged from the transmission rod 101, a switching operation can be performed. During the switching operation, the third gear 203, the fourth gear 204, and the rod adapter 207 may move in the lateral direction to selectively engage any one of the plurality of transmission rods 101. In order to enable the third gear 203 and the fourth gear 204 to move synchronously in the lateral direction, the third gear 203 and the fourth gear 204 may be rotatably clamped in a gear holder 209. As shown in FIG. 5, the gear holder 209 may comprise an upper half 210 and a lower half 211 that are separable from each other. Both the upper half 210 and the lower half 211 are provided with semi-circular grooves 212 for accommodating the rotation shaft of the third gear 203 and semi-circular grooves 213 for accommodating the rotation shaft of the fourth gear 204. The upper half 210 and the lower half 211 may be connected together by screws to rotatably clamp the third gear 203 and the fourth gear 204 in the grooves 212 and 213, respectively. The top of the upper half 210 is provided with lateral holes 216 and 217 through which the guide rods 214 (FIG. 2) and 215 (FIG. 2) extend, respectively. The guide rods 214 and 215 are used to guide the lateral movement of the gear holder 209.

Figure 6:
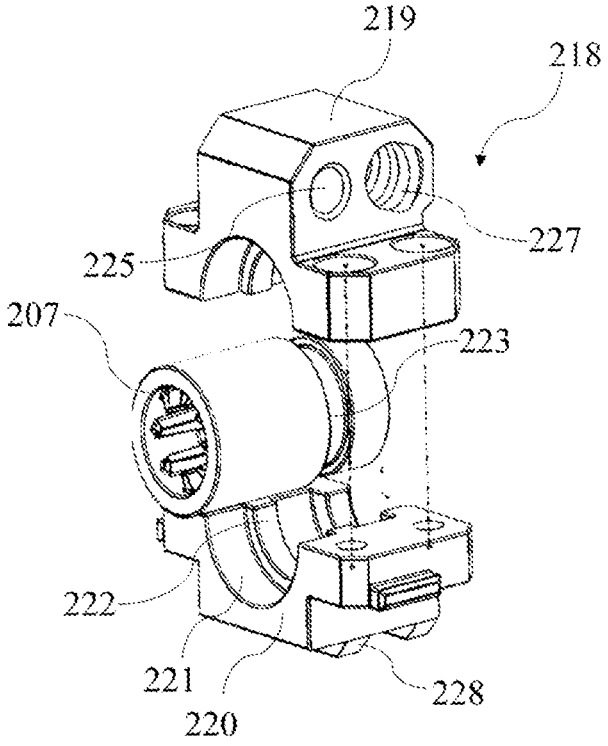
FIG. 6 shows a perspective view of a rod adapter holder according to an embodiment of the present disclosure.

In addition, the rod adapter 207 may be rotatably clamped in the rod adapter holder 218 to move between the engaged position and the disengaged position in the axial direction and to move in the lateral direction, under the action of the rod adapter holder 218. As shown in FIG. 6, the rod adapter holder 218 may comprise an upper half 219 and a lower half 220 that are separable from each other. Both the upper half 219 and the lower half 220 are provided with semi-circular grooves 221 for receiving the rod adapter 207. The inner surfaces of the semi-circular grooves 221 are provided with annular protrusions 222 that mate with the annular groove 223 provided in the rod adapter 207 to restrict the axial movement of the rod adapter 207 relative to the rod adapter holder 218. The upper half 219 and the lower half 220 may be connected together by screws to rotatably clamp the rod adapter 207 in the semi-circular grooves 221. The top of the upper half 219 is provided with a lateral hole 225 through which a guide rod 224 extends and a lateral threaded hole 227 through which the screw 226 (FIGS. 7 and 9) extends (see also, e.g., FIG. 4). When the screw 226 rotates, the rod adapter holder 218 can move laterally along the screw 226, thereby driving the rod adapter 207, the gear holder 209, and the third gear 203 and the fourth gear 204 held in the gear holder 209 move laterally together. The guide rod 224 is used to guide the lateral movement of the rod adapter holder 218.

Figure 7:
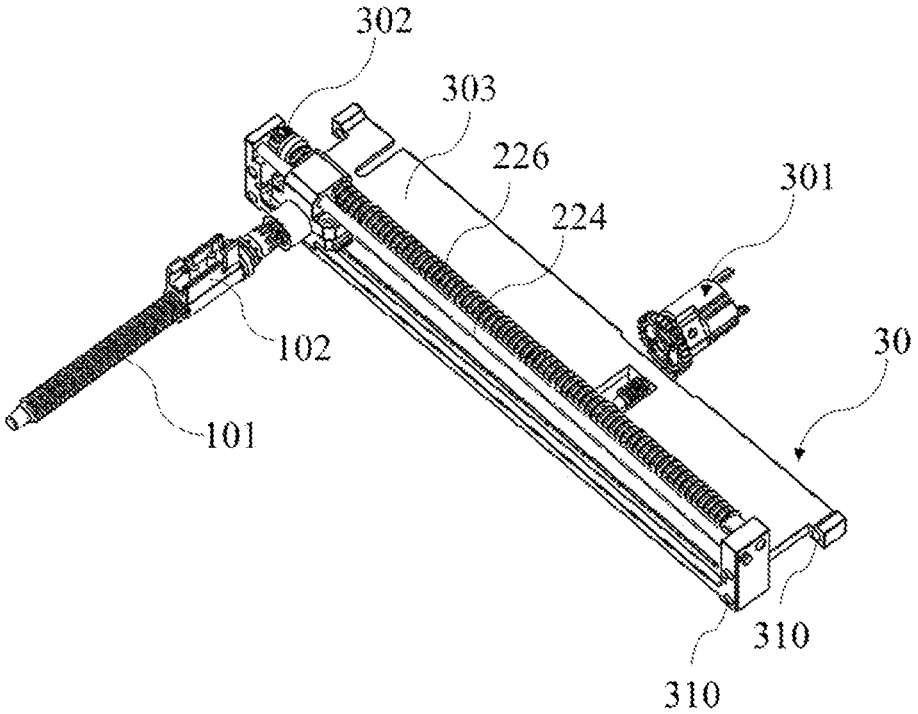
FIG. 7 shows a perspective view of a switch unit of the switchable transmission mechanism for a base station antenna according to an embodiment of the present disclosure.

In embodiments according to the present disclosure, both the axial movement and the lateral movement of the rod adapter holder 218 are realized by the switch unit 30. The specific structure of the switch unit 30 will be described with reference to FIGS. 7 to 9. As shown in FIG. 7, the switch unit 30 may comprise an axial drive assembly 301 and a lateral drive assembly 302. The axial drive assembly 301 is configured to move the rod adapter 207 between the engaged position and the disengaged position along the axial direction, and the lateral drive assembly 302 is configured to laterally move the rod adapter 207 and the second gear assembly composed of the third gear 203 and the fourth gear 204 when the rod adapter 207 is disengaged from the transmission rod 101.

Figure 8:
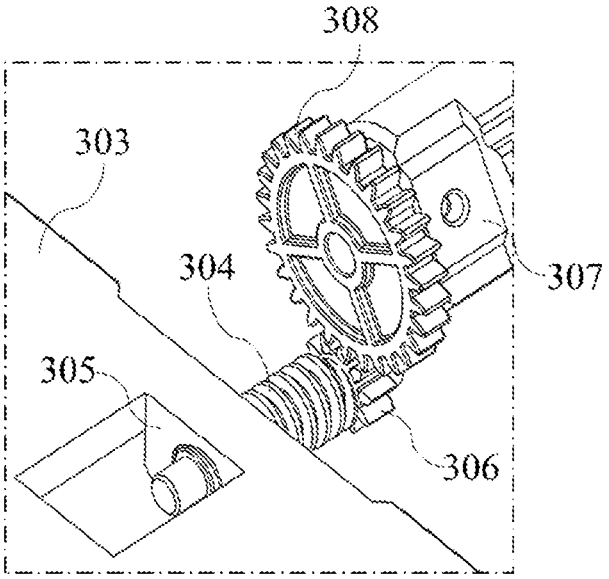
FIG. 8 shows a partial perspective view of an axial drive assembly of the switch unit according to an embodiment of the present disclosure.

As shown in FIG. 7 and FIG. 8, the axial drive assembly 301 comprises an axially movable sliding plate 303 and a transmission shaft 304 for axially moving the sliding plate 303. As shown in FIG. 8, the transmission shaft 304 may be configured as a screw. One end of the transmission shaft 304 is screwed to an end surface 305 of the sliding plate 303 to axially move the sliding plate 303 when the transmission shaft 304 rotates. The other end of the transmission shaft 304 is provided with a spur gear 306 that meshes with a spur gear 308 mounted on the end of the motor adapter 307. The motor adapter 307 is driven by a second motor (not shown), so that the spur gear 308 of the motor adapter 307 drives the spur gear 306 of the transmission shaft 304 to rotate the transmission shaft 304, thereby moving the sliding plate 303 axially. The transmission ratio of the spur gears 308 and 306 can be selected to obtain a desired axial moving speed of the sliding plate 303.

The sliding plate 303 is configured such that the sliding plate 303 can drive the rod adapter holder 218 mounted thereon to move axially with it, thereby enabling the rod adapter 207 to move axially between the engaged position and the disengaged position. To this end, the sliding plate 303 is provided with two spaced apart laterally extending grooves 309 (one of the grooves 309 is clearly shown in FIG. 9). Correspondingly, the bottom of the lower half 220 of the rod adapter holder 218 are provided with two protrusions 228 (FIG. 6) extending laterally, and each protrusion 228 may be received in a corresponding groove 309. In this way, the rod adapter holder 218 can be moved axially together with the sliding plate 303 under the driving of the sliding plate 303 by the cooperation of the protrusions 228 and the grooves 309, and the rod adapter holder 218 can also move laterally on the sliding plate 303. In addition, in order to axially move the sliding plate 303 more smoothly, both ends of the sliding plate 303 may be respectively installed on two guide rods (not shown) extending axially. Each guide rod may extend through guide holes 310 provided at either end of the sliding plate 303, and both ends of each guide rod may be fixed to the first side wall 401 and the second side wall 402 of the frame 40 (see also, e.g., FIG. 1 and FIG. 7).

Figure 9:
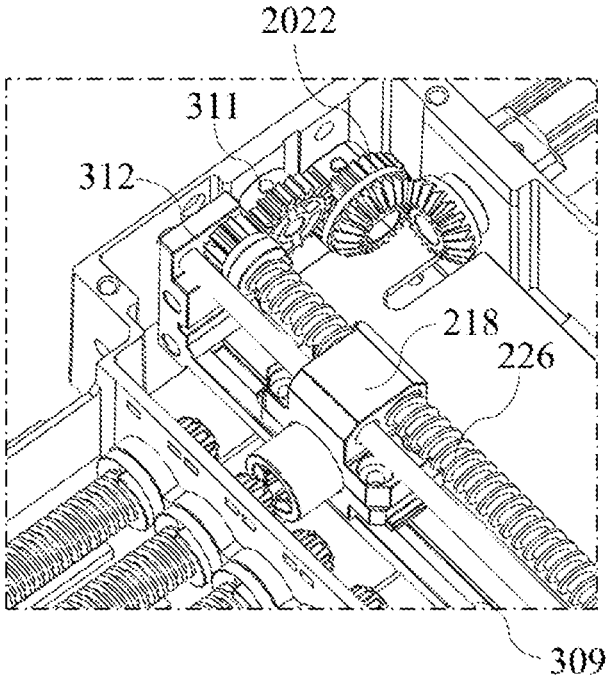
FIG. 9 shows a partial perspective view of a lateral drive assembly of the switch unit according to an embodiment of the present disclosure.

When the axial drive assembly 301 moves the rod adapter 207 to the disengaged position, the rod adapter 207 and the second gear assembly composed of the third gear 203 and the fourth gear 204 are laterally moved via the lateral drive assembly 302. FIG. 9 shows the specific structure of the lateral drive assembly. In embodiments according to the present disclosure, the lateral drive assembly comprises the fifth gear 311 and the sixth gear 312. The fifth gear 311 is configured to be rotatably fixed on the first end wall 403 of the frame 40, and the sixth gear 312 is configured to be rotatably fixed on an end wall of the sliding plate 303 to be axially moved between a meshing position and a non-meshing position in response to the axial movement of the sliding plate 303. In the meshing position, the rod adapter 207 is disengaged from the transmission rod 101, and the sixth gear 312 meshes with the fifth gear 311 and can be rotated by the fifth gear 311; in the non-meshing position, the rod adapter 207 is engaged with the transmission rod 101, and the sixth gear 312 and the fifth gear 311 are separated from each other. The sixth gear 312 may be fixedly connected to the screw 226 or integrally formed as one end of the screw 226. In this way, when the sixth gear 312 rotates, it will drive the screw 226 to rotate. The rotation of the screw 226 causes the rod adapter holder 218 to move laterally along the screw 226, thereby driving the rod adapter 207, the gear holder 209, and the third gear 203 and the fourth gear 204 held in the gear holder 209 to move laterally together.

In embodiments according to the present disclosure, the fifth gear 311 and the sixth gear 312 may be configured as spur gears. In order to reduce the number of driving devices and other components, the lateral drive assembly 302 is configured to be driven by the first motor via the first gear assembly. Specifically, the fifth gear 311 is configured to be transmissibly connected to the second gear 202 of the first gear assembly. To this end, the second gear 202 comprises a spur gear portion 2022 that meshes with the fifth gear 311 in addition to the bevel gear portion 2021 that meshes with the first gear 201 (see, e.g., FIG. 3). During the switching operation, the first motor drives the first gear 201, the first gear 201 drives the second gear 202 via the bevel gear portion 2021 meshed therewith, the second gear 202 drives the fifth gear 311 via its spur gear portion 2022, and the fifth gear 311 in turn drives the sixth gear 312. Such a configuration avoids additional driving devices and transmission components, and thus simplifies the structure of the entire transmission mechanism.

In embodiments according to the present disclosure, the bevel gear portion 2021 and the spur gear portion 2022 of the second gear 202 may be integrally formed, or may be configured as two separate components fixedly connected to each other. In embodiments according to the present disclosure, in addition to the guide rods which are made of metal, all the other components (e.g., the first gear 201, the second gear 202, the third gear 203, the fourth gear 204, the fifth gear 311, the sixth gear 312, the gear holder 209, the rod adapter holder 218, the screw 226, the transmission shafts 205 and 304, etc.) can be made of plastic materials, such as polyoxymethylene (POM) material or polybutylene terephthalate (PBT) material. This reduces the weight and the cost of the switchable transmission mechanism 10. In addition, since the screw 226 can be made of plastic material, the screw 226 can be manufactured as a non-standard part. This makes it possible to select the size of the pitch of the screw 226 as required, so that a desired lateral movement speed of the rod adapter holder 218 and the rod adapter 207 can be selected to implement the switching operation more accurately.

Figure 10:
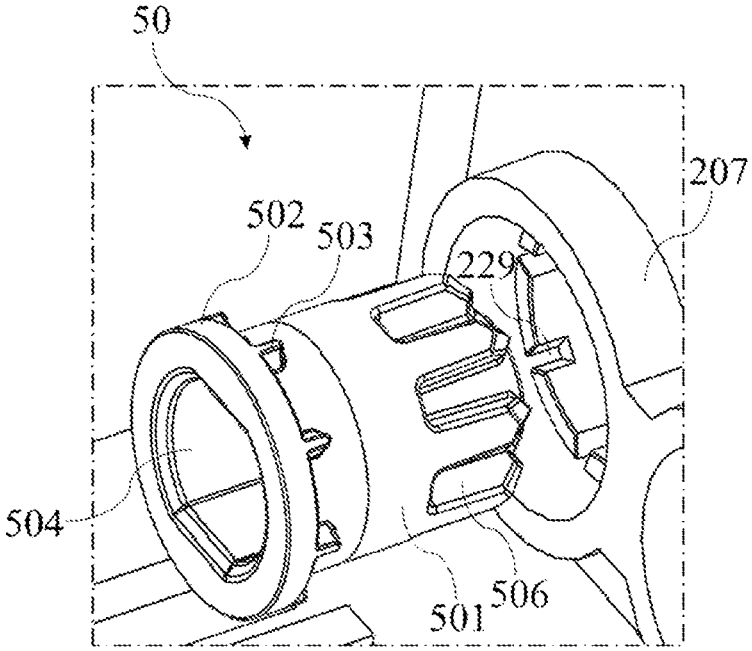
FIGS. 10 to 12 show a specific structure of a locking mechanism for a transmission rod according to an embodiment of the present disclosure.
Figure 11:
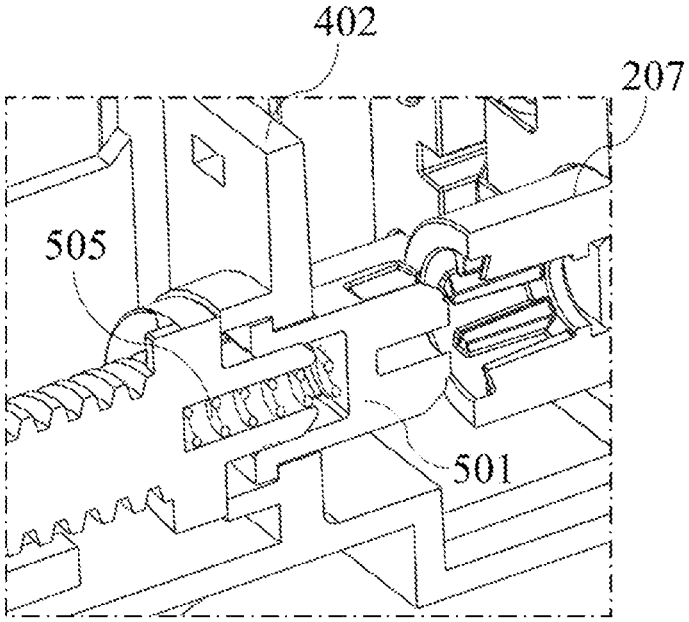
Figure 12:
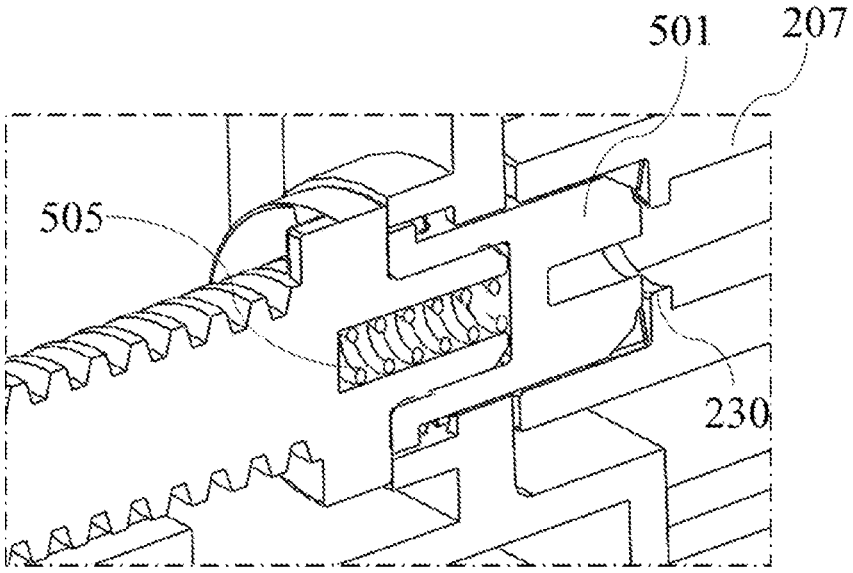

The switchable transmission mechanism 10 according to the present disclosure may further comprise a locking mechanism 50 for the transmission rod 101. The locking mechanism 50 is configured to prevent the transmission rod 101 from rotating, so as to avoid changing the setting of the phase shifter when the rod adapter 207 is disengaged from the transmission rod 101. Referring to FIGS. 10 to 12, a specific structure of the locking mechanism 50 is shown. As shown in FIG. 10, the locking mechanism 50 comprises bushings 501 installed at one end of each transmission rod 101. Each bushing 501 is configured to be non-rotatable relative to the transmission rod 101. A flange 502 is provided at one end of the bushing 501, and a plurality of keys 503 distributed along the circumferential direction of the flange 502 and extending in the axial direction of the bushing 501 are provided on a side surface of the flange 502. The keys 503 may mate with key slots (not shown) provided in the second side wall 402 of the frame 40 to lock the bushing 501, so as to prevent the bushing 501 and the transmission rod 101 from rotating. The end of the bushing 501 provided with the flange 502 is further provided with a non-circular inner cavity 504 into which the end of the transmission rod 101 can be inserted, and the inner cavity 504 extends through a part of the bushing 501 in the axial direction. An elastic member (such as a spring 505) is provided in the inner cavity 504, and the spring 505 can push the bushing 501 in the axial direction (see, e.g., FIG. 11 and FIG. 12). The other end of the bushing 501 can extend through the second side wall 402 of the frame 40 to be inserted into the inner cavity 504 of the rod adapter 207. The outer surface of the other end of the bushing 501 is provided with a plurality of key slots 506 distributed along the circumferential direction. The key slots 506 can mate with the keys 229 (FIG. 10) provided in the inner cavity of the rod adapter 207 to prevent the bushing 501 from rotating relative to the rod adapter 207. An annular protrusion 230 is also provided in the inner cavity of the rod adapter 207, and the annular protrusion 230 is used to limit the insertion depth of the bushing 501 into the inner cavity of the rod adapter 207.

As shown in FIG. 11 and FIG. 12, when the bushing 501 is disengaged from the rod adapter 207, the spring 505 pushes the bushing 501 in a direction that brings the flange 502 of the bushing 501 closer to the second side wall 402 of the frame 40, so that the keys 53 of the bushing 501 will enter into the key slots of the second side wall 402, thereby making the bushing 501 and the transmission rod 101 being locked from rotation (as shown in FIG. 11). When the bushing 501 is engaged with the rod adapter 207, the annular protrusion 230 (FIG. 12) of the rod adapter 207 abuts the end of the bushing 501 inserted into the inner cavity of the rod adapter 207 and pushes the bushing 501 in a direction that brings the flange 502 of the bushing 501 away from the second side wall 402 of the frame 40, so that the keys 503 of the bushing 501 come out of the key slots of the second side wall 402, thereby making the bushing 501 and the transmission rod 101 being unlocked and rotatable (as shown in the FIG. 12). The locking mechanism 50 can automatically lock the transmission rod 101 from rotation when the transmission rod 101 is disengaged from the rod adapter 207, thereby preventing the setting of the phase shifter from being changed. This is particularly advantageous during transportation or installation of base station antennas.

The exemplary embodiments according to the present disclosure have been described above with reference to the accompanying drawings. However, those skilled in the art should appreciate that a plurality of changes and modifications may be made to the exemplary embodiments of the present disclosure without departing from the spirit and scope of the present disclosure. All the changes and modifications are encompassed within the protection scope of the present invention as defined by the claims. The present invention is defined by the appended claims, and the equivalents of these claims are also contained therein.

What is claimed is:

1. A switchable transmission mechanism for a base station antenna, comprising:

a plurality of axially drivable members, wherein each member is mounted on a corresponding one of a plurality of transmission rods arranged in parallel and is configured to be connected with a corresponding one of a plurality of phase shifters in the base station antenna;

a transmission unit including a first gear assembly and a second gear assembly transmissibly connected to the first gear assembly, wherein the second gear assembly is engageable with or dis-engageable from any one of the plurality of transmission rods via a rod adapter that is movable between an engaged position and a disengaged position along an axial direction of a respective transmission rod; and a switch unit configured to move the second gear assembly along a lateral direction perpendicular to the axial direction when the second gear assembly is disengaged from any one of the plurality of transmission rods, so that the switchable transmission mechanism can selectively drive any one of the plurality of transmission rods.

2. The switchable transmission mechanism for a base station antenna according to claim 1, wherein the first gear assembly and the second gear assembly are arranged substantially at a same height.

3. The switchable transmission mechanism for a base station antenna according to claim 1, wherein the first gear assembly comprises a first gear and a second gear that mesh with each other, the second gear assembly comprises a third gear and a fourth gear that mesh with each other, and wherein the third gear is transmissibly connected to the second gear via a transmission shaft extending along the lateral direction, and the transmission shaft has a non-circular peripheral shape.

4. The switchable transmission mechanism for a base station antenna according to claim 3, wherein a central axis of the first gear and a central axis of the second gear are perpendicular to each other.

5. The switchable transmission mechanism for a base station antenna according to claim 4, wherein the first gear is a bevel gear, and the second gear comprises a bevel gear portion that meshes with the first gear.

6. The switchable transmission mechanism for a base station antenna according to claim 3, wherein a center axis of the third gear and a center axis of the fourth gear are perpendicular to each other.

7. The switchable transmission mechanism for a base station antenna according to claim 6, wherein both the third gear and the fourth gear are bevel gears.

8. The switchable transmission mechanism for a base station antenna according to claim 7, wherein the third gear and the fourth gear are rotatably clamped in a gear holder so that the third gear and the fourth gear can move laterally in response to a lateral movement of the gear holder.

9. The switchable transmission mechanism for a base station antenna according to claim 8, wherein the gear holder is made of plastic and comprises an upper half and a lower half.

10. The switchable transmission mechanism for a base station antenna according to claim 8, further comprising a guide rod for guiding lateral movement of the gear holder.

11. The switchable transmission mechanism for a base station antenna according to claim 3, wherein the first gear, the second gear, the third gear, the fourth gear, and the transmission shaft are made of plastic.

12. The switchable transmission mechanism for a base station antenna according to claim 3, wherein the fourth gear is configured to be engaged with or disengaged from any one of the plurality of transmission rods via the rod adapter.

13. The switchable transmission mechanism for a base station antenna according to claim 12, wherein the rod adapter is rotatably clamped in a rod adapter holder so that the rod adapter can move axially between the engaged position and the disengaged position in response to an axial movement of the rod adapter holder and move laterally in response to a lateral movement of the rod adapter holder.

14. The switchable transmission mechanism for a base station antenna according to claim 13, wherein the rod adapter holder is made of plastic and comprises an upper half and a lower half.

15. The switchable transmission mechanism for a base station antenna according to claim 13, further comprising a screw for driving the rod adapter holder to move the rod adapter holder laterally.

16. The switchable transmission mechanism for a base station antenna according to claim 15, further comprising a guide rod for guiding lateral movement of the rod adapter holder.

17. The switchable transmission mechanism for a base station antenna according to claim 1, wherein the switch unit comprises an axial drive assembly and a lateral drive assembly, and wherein the axial drive assembly is configured to move the rod adapter between the engaged position and the disengaged position along the axial direction, and the lateral drive assembly is configured to drive the second gear assembly along the lateral direction when the rod adapter is disengaged from any one of the plurality of transmission rods.

18. The switchable transmission mechanism for a base station antenna according to claim 17, wherein the lateral drive assembly comprises an axially movable sliding plate and a transmission shaft for axially moving the sliding plate, and the sliding plate is configured to move the rod adapter between the engaged position and the disengaged position along the axial direction when the sliding plate moves axially.

19. The switchable transmission mechanism for a base station antenna according to claim 17, wherein the lateral drive assembly comprises a third gear assembly configured to laterally move the rod adapter via the rod adapter holder by rotating a screw.

20. The switchable transmission mechanism for a base station antenna according to claim 19, wherein a size of pitch of the screw can be selected to obtain a desired lateral movement speed of the rod adapter.

21. The switchable transmission mechanism for a base station antenna according to claim 19, wherein the third gear assembly is configured to transmissibly connected to the first gear assembly so that the third gear assembly and the first gear assembly are driven by a same driving device.

22. The switchable transmission mechanism for a base station antenna according to claim 19, wherein the third gear assembly comprises a fifth gear and a sixth gear, and wherein when the rod adapter is disengaged from any one of the plurality of transmission rods, the fifth gear and the sixth gear mesh with each other, and when the rod adapter is engaged with any one of the plurality of transmission rods, the fifth gear and the sixth gear are separated from each other.

23. The switchable transmission mechanism for a base station antenna according to claim 22, wherein the fifth gear, the sixth gear, and the screw are made of plastic.

24. The switchable transmission mechanism for a base station antenna according to claim 22, wherein both the fifth gear and the sixth gear are spur gears.

25. The switchable transmission mechanism for a base station antenna according to claim 1, further comprising a locking mechanism, wherein the locking mechanism is configured to prevent the respective transmission rod from rotating when the rod adapter is disengaged from any one of the plurality of transmission rods, so as to avoid changing phase angle of the phase shifter.

26. The switchable transmission mechanism for a base station antenna according to claim 25, wherein the locking mechanism comprises bushings installed at one end of each transmission rod, and wherein each bushing comprises a flange, a side surface of the bushing is provided with a plurality of keys distributed along a circumferential direction of the flange and extending along an axial direction of the bushing, the keys being configured to mate with key slots provided in a frame of the switchable transmission mechanism to achieve locking.

27. The switchable transmission mechanism for a base station antenna according to claim 26, wherein the locking mechanism comprises elastic members, and when the rod adapter is disengaged from the respective transmission rod, the elastic members can automatically push the bushings along the axial direction to a position where the keys mate with the key slots.

* * * * *